United States Patent [19]

Stakelbeck

[11] Patent Number: 4,503,191

[45] Date of Patent: Mar. 5, 1985

[54] BACKSIZING COMPOSITIONS FOR TEXTILE MATERIALS AND METHOD OF BACKSIZING TEXTILES THEREWITH

[75] Inventor: Hans-Peter Stakelbeck, Binzen, Fed. Rep. of Germany

[73] Assignee: Sandoz Ltd., Basel, Switzerland

[21] Appl. No.: 549,685

[22] Filed: Nov. 7, 1983

[30] Foreign Application Priority Data

Nov. 8, 1982 [DE] Fed. Rep. of Germany ..... 3241148

[51] Int. Cl.[3] ..... C08K 5/42

[52] U.S. Cl. ..... 524/159; 524/158; 8/495; 8/589; 8/590

[58] Field of Search ..... 8/587, 588, 589, 590, 8/591; 524/157, 158, 159

[56] References Cited

U.S. PATENT DOCUMENTS 3,264,246 8/1966 Donaldson et al. ..... 260/29.7

*Primary Examiner*—Paul R. Michl

*Attorney, Agent, or Firm*—Gerald D. Sharkin; Richard E. Vila; Thomas C. Doyle

[57] ABSTRACT

Textile materials, preferably carpets, are backsized with a composition comprising (a) a natural or synthetic polymeric latex (b) a filler, and (c) a fixing agent for anionic dyestuffs.

The resulting textile materials are fast to water spotting.

20 Claims, No Drawings

BACKSIZING COMPOSITIONS FOR TEXTILE MATERIALS AND METHOD OF BACKSIZING TEXTILES THEREWITH

The invention relates to a method for preventing water spotting of backsized textile materials, particularly dyed or printed polyamide carpets.

Textile materials backsized with backing compositions, for example as used for carpet backing, often do not exhibit the desired degree of water fastness such as is required for a carpet in everyday use. When water is spilled on such a material, the material often remains stained with coloured spots after drying. It is believed that this water spotting is due to certain of the components of the backing compositions, for example the emulsifying, wetting or dispersing agents, which penetrate into the material and migrate to its surface in the presence of water. When the textile material is dyed or printed, the components of the backing composition can also release the fixed dyestuffs which in turn migrate to the surface in the presence of water and thus increase the degree of staining.

It has now been found that by applying a fixing agent for anionic dyestuffs directly at the source of migration, the water fastness, especially the fastness to water spotting, is significantly improved.

Accordingly, the present invention provides a backing composition comprising (a) a natural or synthetic polymeric latex (b) a filler, and (c) a fixing agent for anionic dyestuffs.

The polymer latices (a) include polymer dispersions, emulsions and solutions such as are used for backsizing wall- or floor-coverings, e.g. carpets, particularly tufted carpets. Such latices are applied on the back side of a textile material to enhance the pile anchorage, the dimensional stability and the resistance to slip.

Examples of appropriate latices (a) that may be mentioned are latices based on rubber or homo- and copolymers of butadiene, vinyl chloride, styrene, acrylonitrile, isoprene, isobutylene, chloroprene, vinyl esters such as vinyl acetate and proprionate, acrylic esters such as methyl and butyl acrylate and methacrylic esters such as methyl methacrylate. Such latices are commercially available and their compositions vary depending on the manufacturer and the desired final properties. Commercially available latices may contain a dispersing, wetting or emulsifying agent to enhance their stability during storage. Such agents may be anionic or non-ionic, e.g., sulphonates, for example sodium or potassium alkylsulphonates such as $C_{4-18}$alkylsulphonates, arylsulphonates such as naphthylsulphonates, alkylarylsulphonates such as $C_{4-10}$alkylnaphthylsulphonates, and sulphonated oils such as sulphonated caster oil, and polyglycol ethers of fatty acids, fatty alcohols and alkylphenols. In general, however, the structural formulae of the dispersing, wetting or emulsifying agents present in the latices are not released by the manufacturers.

Suitable fillers (b) include the loading and extending materials which are usually mixed with commercially available latices. Examples of appropriate fillers that may be mentioned are clay, bentonite clay, calcium carbonate, titanium dioxide and the like.

Suitable fixing agents (c) are compounds which are effective in the fixation of anionic dyestuffs, particularly as used in the dyeing of polyamide fibres. Preferred fixing agents are synthetic tanning agents, particularly condensation products of aromatic sulphonic acids or of phenolic structure.

Preferred synthetic tanning agents are (i) diphenyl compounds of formula I

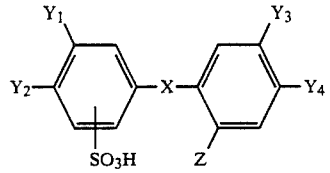

I wherein

X is oxygen, sulphur, —NHCONH—, —NHCO— or —CONH—, each of $Y_1$, $Y_2$, $Y_3$ and $Y_4$ is independently hydrogen, fluorine, chlorine, bromine or $CF_3$, with the proviso that at least one of $Y_1$, $Y_2$, $Y_3$ and $Y_4$ is halogen and at most one of $Y_1$, $Y_2$, $Y_3$ and $Y_4$ is $CF_3$, and Z is hydrogen, $(C_{1-6})$alkanoylamino or

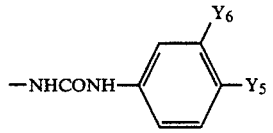

wherein $Y_5$ and $Y_6$ are independently hydrogen, halogen or $CF_3$, with the proviso that at most one of $Y_5$ and $Y_6$ is $CF_3$;

(ii) polyhydroxypolyarylpolysulphones such as described in DAS 1 012 070;

(iii) anionic polycondensation products of diarylsulphones containing at least one phenolic hydroxyl and hydroxybenzene sulphonic acids with formaldehyde or a compound liberating formaldehyde, e.g. as indicated in DAS No. 1 619 667;

(iv) condensation products of dihydroxydiarylsulphones and benzene sulphonic acids (or analogs) with formaldehyde or a compound liberating formaldehyde;

(v) sulphonated condensation products of phenol, cresol, resorcinol and naphthols with formaldehyde;

(vi) mixed condensation products of sulphonated aromatic hydroxy compounds and aralkylhalogenide with formaldehyde, and (vii) condensation products of bisphenol with formaldehyde which are further sulphomethylated with the sulphite adduct of formaldehyde.

More preferred synthetic tannins are those of type (iv), particularly the condensation products of dihydroxydiphenylsulphone and xylene sulphonic acid with formaldehyde. They may be formed e.g. by heating at 100° an aqueous solution containing about 1 mole of m-xylene sulphonic acid and 1.1 to 1.6 moles of 4,4'-dihydroxydiphenylsulphone or a mixture of 4,4'-dihydroxydiphenylsulphone and 2,2'-dihydroxydiphenylsulphone with 1.5 to 2.3 moles of formaldehyde. The reaction mixture is heated until all formaldehyde is reacted, then neutralised to pH 7. The resulting condensation product may be diluted with water.

When the synthetic tanning agents contain sulphonic acid groups, they may be used either in the free acid or salt form. However, the synthetic tanning agents are preferably employed in the salt form, especially in the alkali metal or ammonium salt form, particularly in the sodium salt form.

The amount of the filler (b) present in the composition of the invention may vary depending on various factors such as the properties of the latex (a), e.g. its ability to accept loading, and the desired final properties of the backsizing. As it will be appreciated the filler is present in an amount which should not adversely affect the properties of the backing composition. Preferably the composition of the invention contains the filler (b) in a dry weight ratio to the latex (a) of from 0.5–10:1, more preferably 1–8:1.

The amount of fixing agent (c) present in the composition of the invention may vary. Preferably the dry weight ratio of the fixing agent (c) to the latex (a) is from 0.1–1:1, more preferably 0.1–0.8:1.

In addition to (a), (b) and (c), the composition of the invention may contain further additives such as stabilisers, anti-oxidants, thickening agents, wetting agents, dispersing agents, emulsifying agents, vulcanising agents, accelerators, pigments, softeners and plasticisers. Preferably the composition of the invention contains a thickening agent, more preferably in a dry weight ratio to the latex of from 0.001–0.1:1.

The composition of the invention suitably has a pH from slightly acidic to alkaline, preferably from 6 to 12. More preferably the pH of the composition is adjusted to 7–9.

The composition may be prepared according to known methods, preferably by mixing the stirring until the mixture is homogeneous. A preferred addition sequence is to mix first the latex (a) with the fixing agent (c) and optionally the selected further additives and then with the filler (b) and optionally a thickening agent.

The present invention further provides a method for preventing water spotting of a backsized textile material comprising applying on the back side of the material a backing composition which comprises (a) a natural or synthetic polymeric latex (b) a filler, and (c) a fixing agent for anionic dyestuffs.

The application of the backing composition on the textile material may be carried out according to known methods, e.g. by a continuous application over the full width of the textile material or by slop-padding. The application can be effected on a wet or a dry substrate, preferably on a dry substrate.

According to a preferred embodiment the backing composition of the invention is applied on a dry textile material which has previously been rinsed with a slightly acidic solution and then dried. The rinsing may be carried out with a diluted organic acid solution, e.g. formic, acetic, citric or tartaric acid. It is particularly preferred to rinse the textile material prior to the backing so that the pH lies within 4 and 7, particularly 4 to 6 and then to dry it.

After the application of the backing composition, the textile material is dried. This drying step may be either a partial drying, e.g. in a pre-drying machine, or a full drying to a residual moisture of up to 12% by weight at a temperature from 90° to 130° C. for 5 to 60 minutes, or a curing at a temperature from 130° to 170° C. for 5 to 15 minutes, or a vulcanisation in the case of natural latex backings under conditions ranging from 20 minutes at 100°–110° C. to 5 minutes at 140° C. All heating media, e.g. hot air, electricity, steam, gas, oil and infrared are generally suitable.

The condition[illegible] application [illegible]

composition used, e.g. a backing composition based on polyvinyl chloride is preferably cured, and on whether the backsized textile material is to be further after-treated e.g. coated or laminated with a secondary backing. This secondary backing can be e.g. a foam backing or the application of a laminating adhesive. Such a further coating is effected when a thicker, softer or more elastic backing is desired or e.g. when improved sound and thermal insulation is required. The secondary backing may conveniently be applied after a partial drying of the primary backing.

The treatment according to the invention can be effected on a textile material which has been dyed, printed or optically brightened. The dyeing, printing or optical brightening of the textile substrate may be carried out according to known methods, preferably with dyestuffs or optical brighteners as used for dyeing or optically brightening a substrate comprising polyamide fibres, preferably anionic dyestuffs, particularly acid dyestuffs. The treatment with the backing composition is suitably performed after the fixation of the dyestuffs or optical brighteners, preferably after an intermediate acidic rinsing and drying as mentioned above. The intermediate acidic rinsing can be avoided when the dyeing or printing is carried out in such a manner that the final pH lies within the range indicated above.

Suitable textile materials include those consisting of or comprising natural or synthetic fibres, preferably natural or synthetic polyamide fibres, among which the latter are preferred. By synthetic polyamide fibres are also to be understood differential dyeing polyamides.

The composition of the invention is particularly preferred for the backsizing of carpets or rugs, especially tufted carpets. The back side of such material may be in any conventional form, e.g. woven, non-woven or net, and consist of natural or synthetic fibres or mixtures of such e.g. jute, polypropylene, polyamides or polyester.

The textile materials, particularly polyamide tufted carpets treated with the composition of the invention exhibit excellent water fastnesses, especially water spotting fastness. Furthermore, the handle and appearance of the treated goods are not adversely affected, the fixing agent being applied directly at the source in small quantities and not over the whole surface in which case a significantly higher amount of fixing agent would be necessary.

The following Examples further serve to illustrate the invention. In the Examples all parts are by weight and all temperatures in degrees Centigrade.

EXAMPLE 1

A 66 polyamide tufted carpet of the basic low regular type and with a polypropylene backing is dyed with acid, basic and contrast dyes, submitted to fixation and washed according to conventional methods. Afterwards the carpet is treated with a bath containing 10 parts citric acid per 100 parts water, squeezed to a pick-up of 40–80% and then dried.

A backing composition containing 292 parts of a commercially available synthetic latex formulation (50%), e.g. based on a carboxylated butadiene-styrene copolymer dispersion (48% styrene, 48% butadiene and 4% carboxylic acid and a commercially available sulphonate dispersing agent)

548 parts clay 23 parts of a commerically available thickening agent, phone and a sulphonated xylene with formaldehyde and 87 parts water is applied by slop padding on the backside of the carpet. The carpet is subsequently dried in a predryer to a moisture content of 50%. After application of a secondary backing composition, e.g. a foam backing, the carpet is finished according to conventional methods.

The resulting carpet possesses an excellent fastness to water spotting.

EXAMPLE 2

A 66 polyamide carpet of the basic low regular type tufted into jute is treated according to the procedure of Example 1, but the backing composition comprises 292 parts clay and 343 parts water instead of the 548 parts clay and 87 parts water.

The resulting carpet exhibits an excellent fastness to water spotting.

Instead of citric acid the carpet can be rinsed with a diluted formic acid solution prior to the application of the backing composition.

What is claimed is:

1. A composition comprising (a) a natural or synthetic polymeric latex (b) a filler, and (c) a fixing agent for anionic dyestuffs.

2. A composition according to claim 1 in which component (a) is a latex based on rubber or homo- and copolymers of butadiene, styrene, acrylonitrile, isoprene, isobutylene, chloroprene, vinyl esters, acrylic or methacrylic acid esters or vinyl chloride.

3. A composition according to claim 1, in which the filler (b) is selected from clay, bentonite clay, calcium carbonate and titanium dioxide.

4. A composition according to claim 1, in which the fixing agent (c) is a synthetic tanning agent selected from

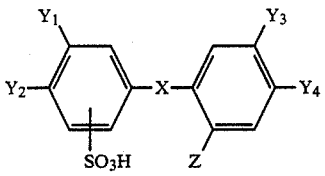

I where

X is oxygen, sulphur, —NHCONH—, —NHCO— or —CONH—, each of $Y_1$, $Y_2$, $Y_3$ and $Y_4$ is independently hydrogen, fluorine, chlorine, bromine or $CF_3$, with the proviso that at least one of $Y_1$, $Y_2$, $Y_3$ and $Y_4$ is halogen and at most one of $Y_1$, $Y_2$, $Y_3$ and $Y_4$ is $CF_3$, and Z is hydrogen, $(C_{1-6})$alkanoylamino or

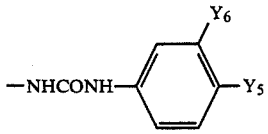

wherein $Y_5$ and $Y_6$ are independently hydrogen, halogen or $CF_3$, with the proviso that at most one of $Y_5$ and $Y_6$ is $CF_3$;

(ii) polyhydroxypolyarylpolysulphones (iii) anionic polycondensation products of diarylsulphones containing at least one phenolic hydroxyl and hydroxybenzene sulphonic acids with formaldehyde or a compound liberating formaldehyde.

(iv) condensation products of dihydroxydiarylsulphones and benzene sulphonic acids (or analogs) with formaldehyde or a compound liberating formaldehyde;

(v) sulphonated condensation products of phenol, cresol, resorcinol and naphthols with formaldehyde;

(vi) mixed condensation products of sulphonated aromatic hydroxy compounds and aralkylhalogenide with formaldehyde, and (vii) condensation products of bisphenol with formaldehyde which are further sulphomethylated with the sulphite adduct of formaldehyde.

5. A composition according to claim 4, in which the synthetic tanning agent is a condensation product of dihydroxydiphenylsulphone and xylene sulphonic acid with formaldehyde.

6. A composition according to claim 1, containing the filler (b) in a dry weight ratio to the latex (a) of from 0.5 to 10:1.

7. A composition according to claim 1 containing the fixing agent (c) in a dry weight ratio to the latex (a) of from 0.1 to 1:1.

8. A composition according to claim 1 containing in addition to components (a),(b) and (c) a thickening agent in a dry weight ratio to the latex (a) of from 0.001 to 0.1:1.

9. A method for preventing water spotting of a backsized textile material comprising applying on the back side of the material a backing composition as defined in claim 1.

10. A method according to claim 9, in which the textile material is rinsed with an acidic solution to obtain a pH ranging from 4 to 7 and then dried prior to the application of the backing composition.

11. A method according to claim 9, in which the textile material is dried or cured after the application of the backing composition.

12. A method according to claim 9, in which the textile material is a carpet comprising natural or synthetic polyamide fibres.

13. A composition according to claim 4 wherein (a) is a polymer dispersion, emulsion or solution, which is useful for backsizing carpets, and the fixing agent (c) is present in a dry weight ratio to (a) of from 0.1–1:1.

14. A composition according to claim 13 wherein component (a) is a latex based on rubber or a homo- or copolymer of butadiene, styrene, acrylonitrile, isoprene, isobutylene, chloroprene, a vinyl ester, an acrylic or methacrylic acid ester or vinyl chloride.

15. A composition according to claim 13 wherein component (a) contains an anionic or non-ionic dispersing, wetting or emulsifying agent.

16. A composition according to claim 15 having a pH of 6 to 12.

17. A composition according to claim 16 in which component (c) is a condensation product of dihydroxydiphenylsulphone and xylene sulphonic acid with formaldehyde.

18. A method according to claim 12 wherein the carpet comprises polyamide fibers dyed or printed with an anionic dyestuff.

19. A method for producing carpet having improved fastness to water spotting which comprises applying a composition according to claim 16 to the back side of carpet material comprising natural or synthetic polyamide fibers dyed or printed with an anionic dyestuff and drying the thus treated material.

20. A method according to claim 19 wherein component (c) of the backing composition is a condensation product of dihydroxydiphenylsulphone and xylene sulphonic acid with formaldehyde.

* * * * *